US008729390B2

(12) United States Patent
Liu et al.

(10) Patent No.: US 8,729,390 B2
(45) Date of Patent: May 20, 2014

(54) TORSION RESISTANT SHIELDED CABLE

(75) Inventors: Suy-Tao Liu, Taipei (TW); Kuo-Wei Fan, Taipei (TW)

(73) Assignee: Walsin Lihwa Corporation, Taipei (TW)

( * ) Notice: Subject to any disclaimer, the term of this patent is extended or adjusted under 35 U.S.C. 154(b) by 168 days.

(21) Appl. No.: 13/415,071

(22) Filed: Mar. 8, 2012

(65) Prior Publication Data

US 2013/0146328 A1 Jun. 13, 2013

(30) Foreign Application Priority Data

Dec. 7, 2011 (TW) ..... 100223086 U

(51) Int. Cl.
*H01B 9/02* (2006.01)

(52) U.S. Cl.
USPC ..... 174/108; 174/102 R

(58) Field of Classification Search
USPC ..... 174/33, 34, 36, 102 R, 103–104, 105 R, 174/106 R, 108, 109
See application file for complete search history.

(56) References Cited

U.S. PATENT DOCUMENTS

| | | | | |
|---|---|---|---|---|
| 2,258,687 | A * | 10/1941 | Peterson | 174/115 |
| 6,195,487 | B1 * | 2/2001 | Anderson et al. | 385/101 |
| 8,173,900 | B2 * | 5/2012 | Martinez et al. | 174/102 R |
| 2007/0044996 | A1 * | 3/2007 | Clark | 174/113 R |

* cited by examiner

*Primary Examiner* — Hoa C Nguyen
*Assistant Examiner* — Amol Patel
(74) *Attorney, Agent, or Firm* — Bacon & Thomas, PLLC

(57) ABSTRACT

The present invention provides a torsion resistant shielded cable which includes at least one conductor; an insulating layer covering outside the conductor; a first isolating layer surrounding the insulating layer; and a shielded layer including a number of wires, single wires or strand wires, wound around the first isolating layer in a clockwise and counter-clockwise alternative order along an axial direction of the conductor to prevent the strand wires from breaking while the torsion resistant shielded cable is twisted.

18 Claims, 5 Drawing Sheets

TORSION RESISTANT SHIELDED CABLE

FIELD OF THE INVENTION

The present invention relates to a shielded cable. More particularly, the present invention relates to a torsion resistant shielded cable applied to a wind turbine.

BACKGROUND OF THE INVENTION

Wind turbines are mainly divided into two major systems, "lift-type" and "resistance-type". The lift-type wind turbines are commonly located at open spaces, such as seaside. They are quite huge and named after their huge lift blades. However, since nature wind is non-directional turbulent flow. The wind turbine must face the wind in the windward side so that the wind can push the lift blades. Hence, there is a herd mechanism on the structure so as to move the lift blades to the windward direction along with the wind. However, corresponding mechanism of the blades and the generator become more complex. Prices are higher. Maintenance costs also go up.

Another type, the "resistance-type", wind turbines have blades similar to the sailing. However, according to practical experiences, it will generate turbulent flows when running and further cause low efficiency. Furthermore, when such generating equipment meets the wind, the blades facing straight to the wind rotate clockwise. Other blades meeting the wind in back rotate counter-clockwise. Such conflict direction of rotation will lead to "braking" phenomenon and affect power generation efficiency.

Whether it is "lift-type" or "resistance-type", the wind turbines are required to produce electricity by rotating blades. Wind turbines need to track the wind direction. The cables connecting the generator should be able to continuously twist forward and reverse with the wind. Although general cables used in the wind turbine have a certain degree of resistance to torsion, when the generator rotates over and over again in long-term, it reverses the cables and finally will cause fracture of the shield lines in the cables. Hence, it is desired for the relevant industry to research and develop a method to avoid the shield lines from breaking while the cables reverse.

SUMMARY OF THE INVENTION

This paragraph extracts and compiles some features of the present invention; other features will be disclosed in the follow-up paragraphs. It is intended to cover various modifications and similar arrangements included within the spirit and scope of the appended claims.

The goal of the present invention is to provide a torsion resistant shielded cable applied to wind turbines. The torsion resistant shielded cable includes: at least one conductor; an insulating layer, covering the conductor; a first isolating layer, surrounding the insulating layer; and a shielded layer, comprising a plurality of shield wires. The shield wires are wound around the first isolating layer in a clockwise and counter-clockwise alternative order along an axial direction of the conductor to prevent the shield wires from breaking while the torsion resistant shielded cable is twisted.

Preferably, the shield wire comprises a clockwise wound section, a counter-clockwise wound section and a buffer section between the clockwise wound section and the counter-clockwise wound section, and the buffer section has a waveform which includes x waves, where x is a multiple of 0.5.

Preferably, the shield wire is wound in a specified arrangement.

Preferably, the specified arrangement is repeated more than twice.

Preferably, the specified arrangement is repeated more than 10 times.

Preferably, the specified arrangement is repeated more than 100 times.

Preferably, the conductor is made by stranding multiple wires.

Preferably, the conductor is made of metal or alloy.

Preferably, the insulating layer comprises dielectric materials of high molecular polymers, organic additives or inorganic additives.

Preferably, the insulating layer is formed by extrusion.

Preferably, the first isolating layer is made by strip-type homogeneous or composite materials.

Preferably, the homogeneous material is polymer, metal or alloy.

Preferably, the composite material is a composition of polymer and metal or polymer and alloy.

Preferably, the insulating layer is longitudinally wrapped or rolled wrapped by the first isolating layer.

Preferably, the shield wire is formed by stranding single-core wires, or multi-core metal wires or multi-core alloy wires.

Preferably, the present invention further comprises a second isolating layer wrapping the shielded layer and an outer sheath layer extruding the second isolating layer.

Preferably, the outer sheath layer is made of weather and torsion resistant materials of high molecular polymers, organic additives or inorganic additives.

Preferably, the shield wire is a single wire or a strand wire.

DETAILED DESCRIPTION OF THE PREFERRED EMBODIMENT

The present invention will now be described more specifically with reference to the following embodiment. It is to be noted that the following descriptions of preferred embodiment of this invention are presented herein for purpose of illumination and description only; it is not intended to be exhaustive or to be limited to the precise form disclosed.

Figure 1:
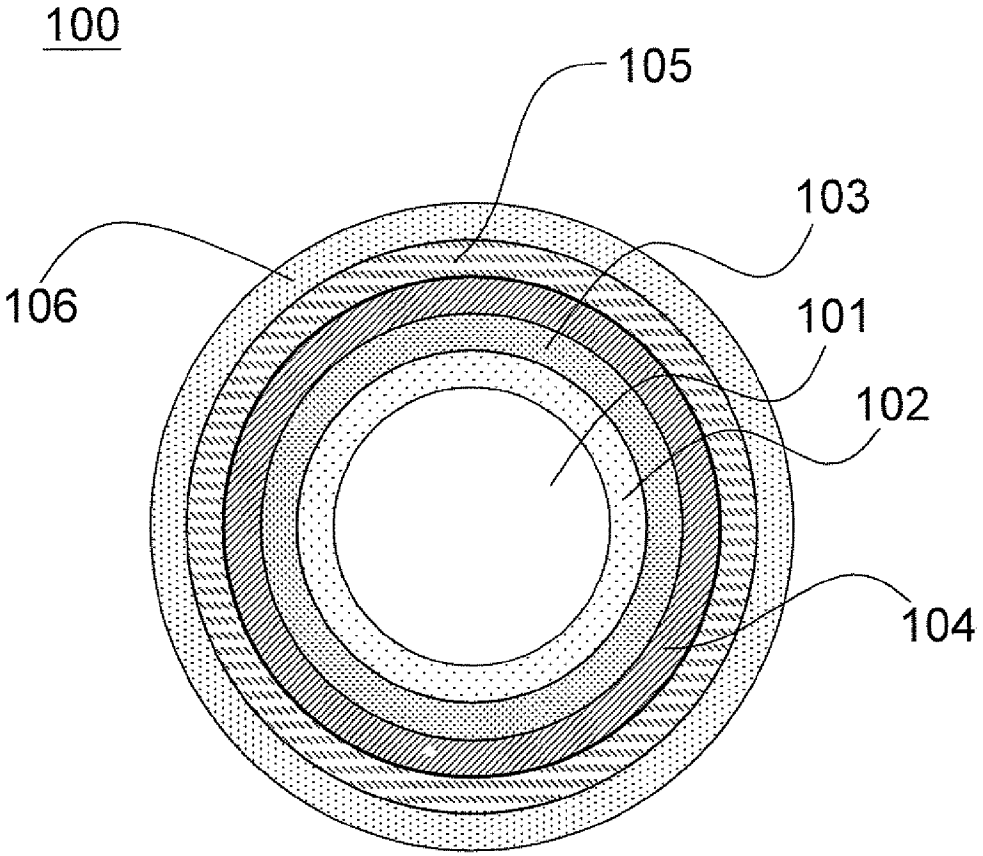
FIG. 1 is a cross-sectional scheme of a single-core torsion resistant shielded cable according to the present invention.
Figure 2:
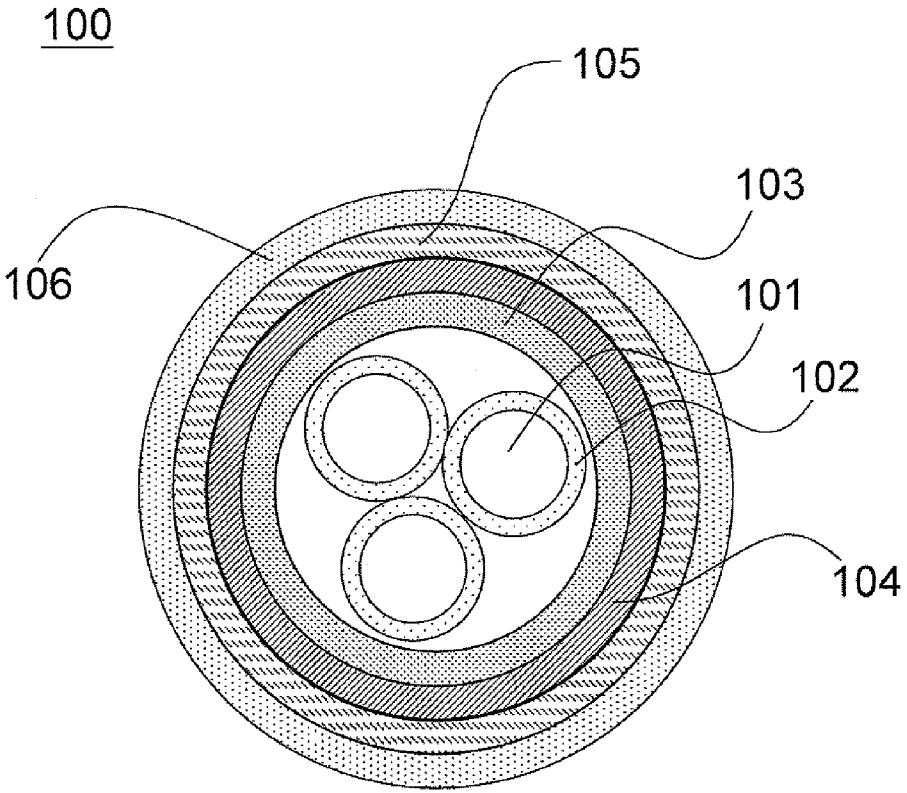
FIG. 2 is a cross-sectional scheme of a multi-core torsion resistant shielded cable according to the present invention.

Please refer to FIG. 1. It is a cross-sectional scheme of a single-core torsion resistant shielded cable according to the present invention. As shown in FIG. 1, the torsion resistant shielded cable 100 includes: a conductor 101, an insulating layer 102, a first isolating layer 103, a shielded layer 104, a second isolating layer 105, and an outer sheath layer 106. According to the spirit of the present invention, the torsion resistant shielded cable 100 can also have multiple conductors 101 to form a multi-core torsion resistant shielded cable 100 as shown in FIG. 2.

The conductor 101 is made of metal or alloy. In the present embodiment, the conductor 101 is formed by stranding multiple copper wires.

The insulating layer 102 is made of single layer or multiple layers of dielectric materials of high molecular polymers, organic additives or inorganic additives and covers the conductor 101. The dielectric material can be mixed powders of the aforementioned materials and be formed by extrusion.

Next, enclosing the insulating layer 102 is the first isolating layer 103. It is made by strip-type homogeneous materials, such as polymers, metal or alloy, or composite materials, such as a composition of polymer and metal or polymer and alloy. As show in FIG. 2, the first isolating layer 103 encloses all of the conductors 101 together. It is not like the insulating layer 102 which covers each conductor 101 separately. The insulating layer 102 is longitudinally wrapped or rolled wrapped by the first isolating layer 103.

In order to effectively prevent external electromagnetic interference and electromagnetic radiation, a shielded layer 104 is wrapped over the first isolating layer 103. The shielded layer 104 is made of multiple shield wires 107. In the present embodiment, the shield wire 107 is formed by stranding single-core wires, or multi-core metal wires or multi-core alloy wires.

The shield wires 107 in a shielded layer of a shielded cable used in conventional wind turbines are usually wound in a single direction and bound by the second isolating layer 105. Therefore, while the cable is twisted back and forth constantly during rotation, the shield wires 107 will slowly bend and deform and finally fatigue fracture due to the continuous tension changes to main the longitudinal length.

Therefore, the key point of the present invention is how to avoid the shield wires 107 from bending and fatigue fracture caused by the constant rotation. In order to achieve such goal, the shield wires 107 in the present invention are wound around the first isolating layer 103 in a clockwise and counter-clockwise alternative order along an axial direction of the conductor 101. Please refer to FIG. 3. By such arrangement, when the torsion resistant shielded cable 100 rotates clockwise, portions of the shield wires 107 wound in clockwise direction (i.e., a clockwise wound section 108) will become tight, and portions of the shield wires 107 wound in counter-clockwise direction (i.e., a counter-clockwise wound section 109) will become loose. On the contrary, when the torsion resistant shielded cable 100 rotates counter-clockwise, the clockwise wound section 108 will become loose, and the counter-clockwise wound section 109 will become tight. Thus, no matter the torsion resistant shielded cable 100 rotates clockwise or counter-clockwise, deformation of each portion of the shield wires 107 can be effectively controlled within a certain range. Furthermore, the shield wires 107 can avoid from breaking caused by over fatigue.

Additionally, in order to further increase the allowable torsion resistant level of the shield wires 107, the shield wires 107 not only include the clockwise wound section 108 and the counter-clockwise wound section 109, but also include a buffer section 110 between the clockwise wound section 108 and the counter-clockwise wound section 109.

Figure 3:
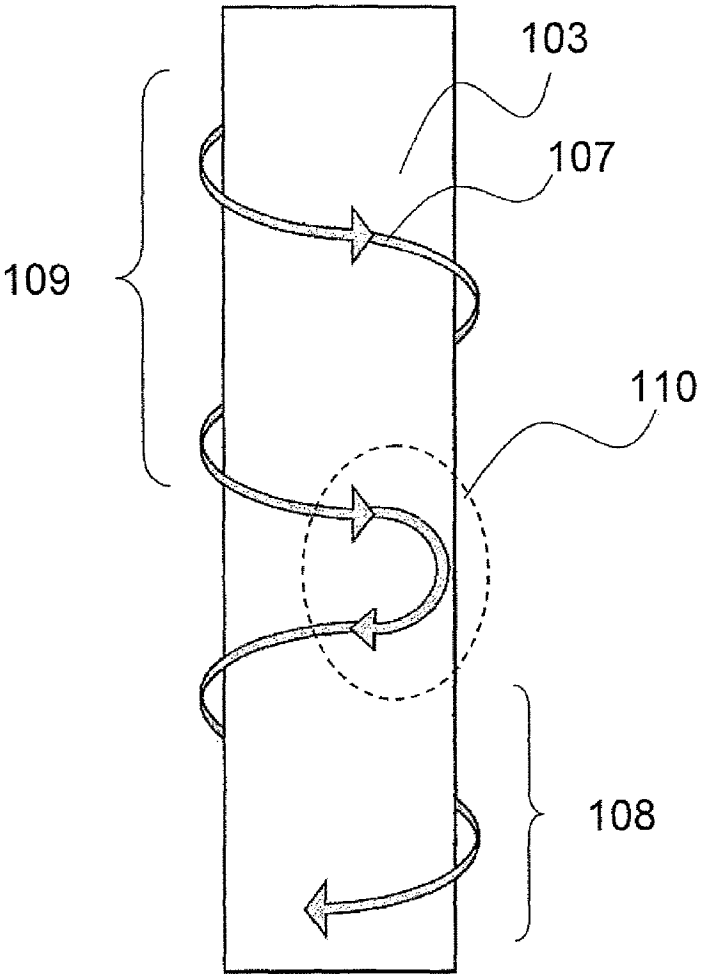
FIG. 3 is a schematic diagram showing how the shield wire winds and covers the isolating layer of the torsion resistant shielded cable according to the present invention.
Figure 4:
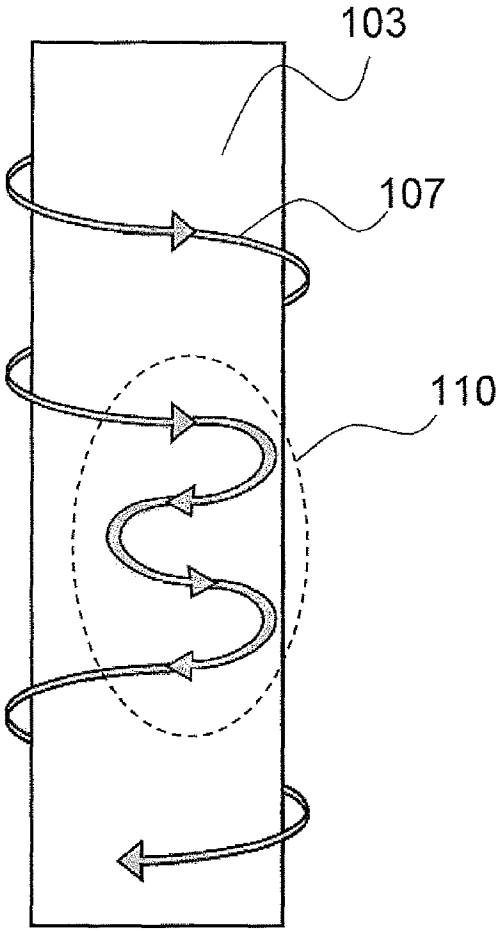
FIG. 4 is another schematic diagram showing how the shield wire winds and covers the isolating layer of the torsion resistant shielded cable according to the present invention.

As shown in FIG. 3, the buffer section 110 of the present embodiment is a half-wave structure. When the shield wires 107 are pulled, the buffer section 110 is able to effectively provide the shield wires 107 an additional extendable length. The buffer section 110 has a waveform. If a longer additional extendable length is required, it is only to make the buffer section 110 of the shield wires 107 more wave arrangement as shown in FIG. 4. More specifically, if an S shape means a complete wave, the number of waves of the waveform in the buffer section 110 of the shield wires 107 is a multiple of 0.5. Take FIG. 4 for example. The waveform of buffer section 110 in the shield wire 107 is formed by three half-waves (i.e., totally 1.5 complete waves).

Figure 5:
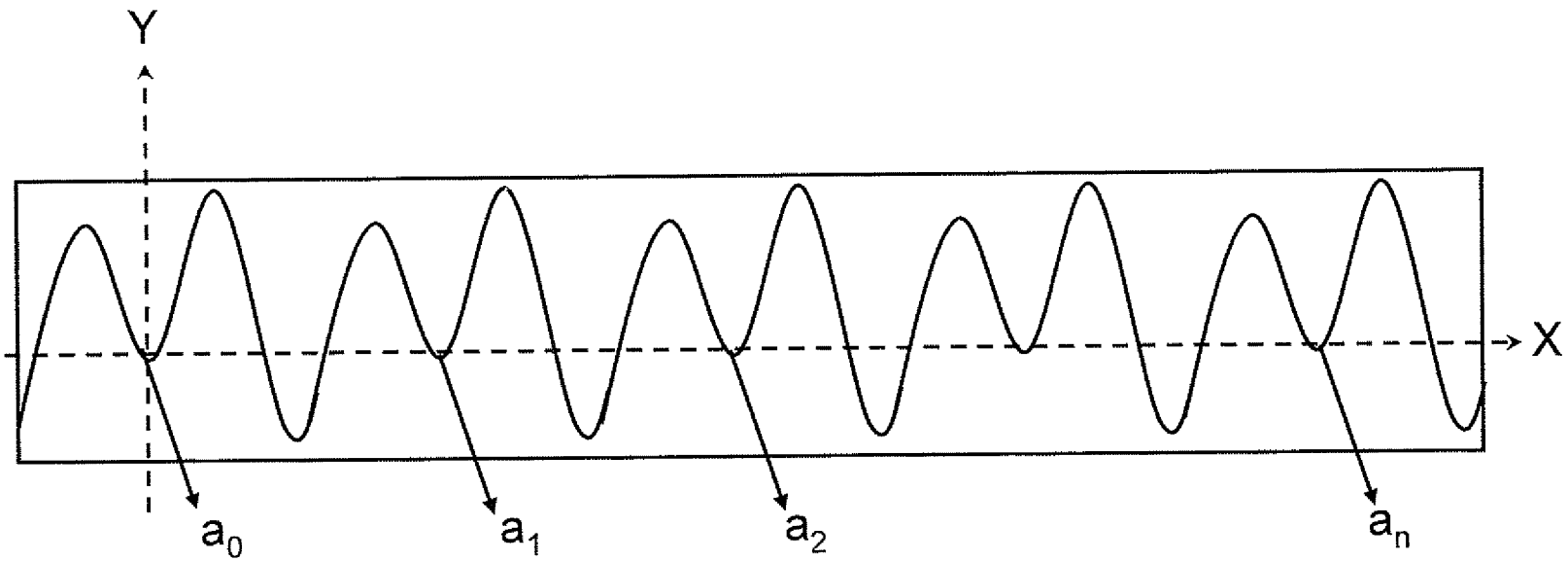
FIG. 5 is a curve diagram illustrating an arrangement of the shield wire along the cable.

Next, please refer to FIG. 5. It is a curve diagram illustrating an arrangement of the shield wire 107 along the torsion resistant shielded cable 100. The shield wire 107 is wound in a specified arrangement. The specified arrangement is usually repeated more than twice. It is better to be more than 10 times. Ideally, it is preferred to be more than 100 times. In other words, if the torsion resistant shielded cable 100 is set as a baseline, as shown in FIG. 5, the curve will have multiple points ($a_0$, $a_1$, $a_2$ . . . $a_n$) that has a slope of 0 and crosses with the baseline. According to the present invention, the first point $a_0$ is set as a reference point and the last point is set as an end point $a_n$, where n is a non-zero even number.

In order to effectively isolate, the torsion resistant shielded cable 100 is wrapped by the second isolating layer 105 over the shielded layer 104. In order to strengthen and protect the overall structure, the outer sheath layer 106 is extruded on the outermost of the torsion resistant shielded cable 100. The outer sheath layer 106 in the present invention can be made of weather and torsion resistant materials of high molecular polymers, organic additives or inorganic additives. Thus, it can be avoided that the torsion resistant shielded cable 100 is damaged under harsh environment or high torsion applied.

While the invention has been described in terms of what is presently considered to be the most practical and preferred embodiment, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A torsion resistant shielded cable for a wind turbine, comprising:

at least one conductor;

an insulating layer, covering the conductor;

a first isolating layer, surrounding the insulating layer;

a shielded layer, including a plurality of shield wires; and a second isolating layer wrapping the shielded layer;

wherein the second isolating layer is made of alloy to provide shielding against electromagnetic interference (EMI) emitted from the torsion resistant shielded cable; and wherein the shield wires are wound around the first isolating layer clockwise and counter-clockwise interleavedly along an axial direction of the conductor to prevent the shield wires from breaking while the torsion resistant shielded cable is twisted back and forth constantly during rotation of the wind turbine.

2. The torsion resistant shielded cable according to claim 1, wherein the shield wire comprises a clockwise wound section, a counter-clockwise wound section and a buffer section between the clockwise wound section and the counter-clockwise wound section, and the buffer section has a waveform which includes x waves, where x is a multiple of 0.5.

3. The torsion resistant shielded cable according to claim 1, wherein the shield wire is wound in a specified arrangement.

4. The torsion resistant shielded cable according to claim 3, wherein the specified arrangement is repeated more than twice.

5. The torsion resistant shielded cable according to claim 3, wherein the specified arrangement is repeated more than 10 times.

6. The torsion resistant shielded cable according to claim 3, wherein the specified arrangement is repeated more than 100 times.

7. The torsion resistant shielded cable according to claim 1, wherein the conductor is made by stranding multiple wires.

8. The torsion resistant shielded cable according to claim 1, wherein the conductor is made of metal or alloy.

9. The torsion resistant shielded cable according to claim 1, wherein the insulating layer comprises dielectric materials of high molecular polymers, organic additives, or inorganic additives.

10. The torsion resistant shielded cable according to claim 1, wherein the insulating layer is formed by extrusion.

11. The torsion resistant shielded cable according to claim 1, wherein the first isolating layer is made by strip-type homogeneous or composite materials.

12. The torsion resistant shielded cable according to claim 11, wherein the homogeneous material is polymer, metal, or alloy.

13. The torsion resistant shielded cable according to claim 11, wherein the composite material is a composition of polymer and metal or polymer and alloy.

14. The torsion resistant shielded cable according to claim 1, wherein the insulating layer is longitudinally wrapped or rolled wrapped by the first isolating layer.

15. The torsion resistant shielded cable according to claim 1, wherein the shield wire is formed by stranding single-core wires, multi-core metal wires, or multi-core alloy wires.

16. The torsion resistant shielded cable according to claim 1, further comprising an outer sheath layer extruding the second isolating layer.

17. The torsion resistant shielded cable according to claim 16, wherein the outer sheath layer is made of weather and torsion resistant materials of high molecular polymers, organic additives, or inorganic additives.

18. The torsion resistant shielded cable according to claim 1, wherein the shield wire is a single wire or a strand wire.

* * * * *